US007373926B2

(12) United States Patent
Eckbauer et al.

(10) Patent No.: US 7,373,926 B2
(45) Date of Patent: May 20, 2008

(54) SUPPORT ELEMENT

(75) Inventors: Andreas Eckbauer, Nuremberg (DE); Martin Riemer, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/590,987

(22) PCT Filed: Feb. 18, 2005

(86) PCT No.: PCT/EP2005/050722

§ 371 (c)(1),
(2), (4) Date: Aug. 25, 2006

(87) PCT Pub. No.: WO2005/083262

PCT Pub. Date: Sep. 9, 2005

(65) Prior Publication Data

US 2007/0175450 A1 Aug. 2, 2007

(30) Foreign Application Priority Data

Feb. 26, 2004 (DE) ..... 10 2004 009 322
Sep. 28, 2004 (DE) ..... 10 2004 047 035

(51) Int. Cl.
*F02M 61/14* (2006.01)

(52) U.S. Cl. ..... 123/470

(58) Field of Classification Search ..... 123/468, 123/469, 470, 456
See application file for complete search history.

(56) References Cited

U.S. PATENT DOCUMENTS

| | | | | |
|---|---|---|---|---|
| 4,294,215 | A * | 10/1981 | Hans et al. | 123/470 |
| 4,984,548 | A * | 1/1991 | Hudson, Jr. | 123/470 |
| 5,136,999 | A * | 8/1992 | Bassler et al. | 123/470 |
| 5,167,213 | A * | 12/1992 | Bassler et al. | 123/470 |
| 5,501,195 | A * | 3/1996 | Hall | 123/470 |
| 5,803,052 | A * | 9/1998 | Lorraine et al. | 123/470 |
| 5,893,351 | A * | 4/1999 | Akutagawa et al. | 123/470 |
| 5,970,953 | A | 10/1999 | Lorraine et al. | |
| 6,276,339 | B1 | 8/2001 | Shebert, Jr. | |
| 6,637,411 | B2 * | 10/2003 | Makiyama | 123/470 |
| 6,684,861 | B2 * | 2/2004 | Reiter | 123/470 |
| 6,748,925 | B1 * | 6/2004 | De Vulpillieres et al. | 123/470 |
| 7,210,462 | B2 * | 5/2007 | Scheffel et al. | 123/470 |

FOREIGN PATENT DOCUMENTS

| | | |
|---|---|---|
| DE | 29 26 490 | 4/1992 |
| DE | 101 63 030 | 7/2003 |

* cited by examiner

*Primary Examiner*—Thomas N Moulis
(74) *Attorney, Agent, or Firm*—Kenyon & Kenyon LLP

(57) ABSTRACT

A support element for the mutual support of a fuel injector in a valve seat, in particular the valve seat of a cylinder head of an internal combustion engine, and of the fuel injector against a fuel distributor, having a clamp and clips provided thereon, as well as a bracket, the fuel injector protruding through a hole therein.

17 Claims, 4 Drawing Sheets

(Stand der Technik)

SUPPORT ELEMENT

FIELD OF THE INVENTION

The invention is generally directed to a support element for holding down a fuel injector inserted into a cylinder head of an internal combustion engine.

DESCRIPTION OF RELATED ART

An attachment device for attaching a fuel injector to an intake manifold, in which the fuel injector is axially fixed to the fuel distributor and to a plug nipple via an attachment element designed as a U-shaped securing clamp having two legs which are flexible in the radial direction, is known heretofore from DE 29 26 490. When mounted, the securing clamp extends through corresponding notches in the plug nipple and can be clicked into place in a recess designed as an annular groove in a connector piece of the fuel injector. The axial play between the notches and the securing clamp and between the annular groove and the securing clamp is to be kept to a minimum, so that the fuel injector may be fixed precisely in place without strain on the seal.

The disadvantage of the known attachment device disclosed in DE 29 26 490 is in particular the fact that the various holding components exert strain upon the fuel injector. The flux of force generated in the fuel injector results in deformations and thereby in changes in the lift and even seizure of the valve needle, and also results in pressure load or bending load on the housing components, which as a general rule have thin walls and are welded to one another at various points. Moreover, every attachment means, e.g., a contact collar, increases the radial dimension of the fuel injector, which in turn means more space is required for installation.

SUMMARY OF THE INVENTION

In contrast, the support element for a fuel injector according to the present invention has the advantage that the fuel distributor rests against the fuel injector via the support element without any radial force being exerted, which means there is no stress and subsequent damage to the fuel injector or to the fuel distributor connector. Due to an appropriately designed bracket, the fuel injector protruding through a hole therein, and clips, the support element ensures that the hold-down force of the fuel distributor is transferred onto the fuel injector, and also allows fixing to be flexible so that tolerances and offsets are compensated for.

In accordance with the present invention, there is provided a support element for the mutual support of a fuel injector (1) in a valve seat, in particular a valve seat of a cylinder head of an internal combustion engine, and of the fuel injector (1) against a fuel distributor (2), wherein the support element (3) has a clamp (8) and clips (4) provided thereon, as well as a bracket (5), the fuel injector (1) protruding through a hole (11) therein.

It is advantageous that the support element may be manufactured in a simple manner by stamping and bending sheet metal. It may also be manufactured via deep-drawing and stamping.

It is advantageous that in the case of the support element according to the present invention there are no screws or tensioned claws for attaching the fuel injector to the front of the cylinder head.

It is particularly advantageous that the surfaces which rest against the fuel distributor and/or the fuel injector are planar.

Furthermore, it is advantageous that, by providing a further elastic bracket which is symmetrical to the first bracket, the flexible support of the fuel distributor may be further improved without additional manufacturing cost.

BRIEF DESCRIPTION OF THE DRAWINGS

The invention will be described in greater detail with reference to the following drawings wherein.

DETAILED DESCRIPTION OF THE INVENTION

Figure 1:
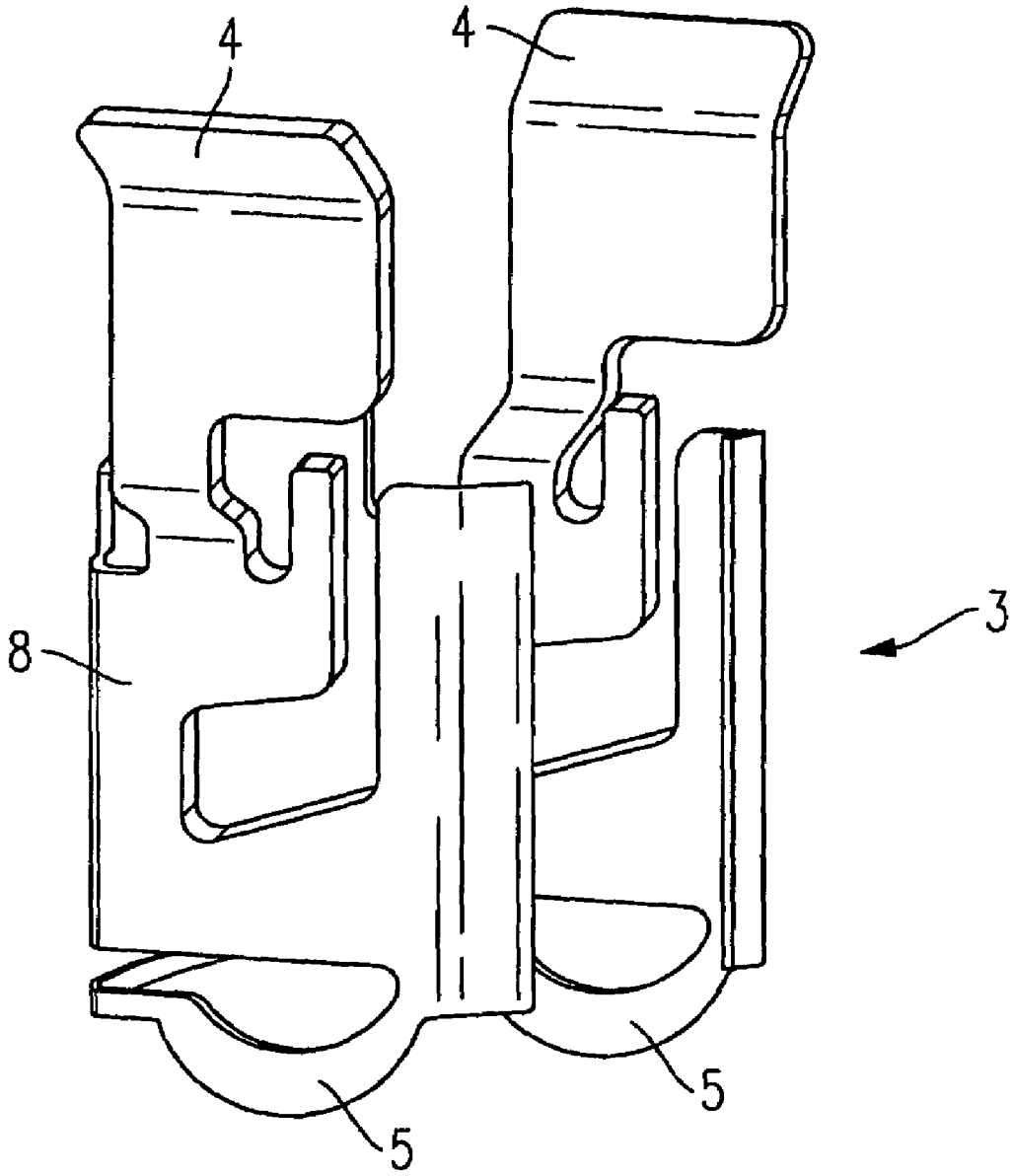
FIG. 1 shows an example of a related-art support element for a fuel injector.

To explain the measures according to the present invention, FIG. 1 first shows a schematic view of a related-art support element 3. Support element 3 is used to secure a fuel injector (not shown in FIG. 1) in a cylinder head of an internal combustion engine and to connect the fuel injector to a fuel distributor. The fuel injector is for example designed as a high-pressure injector of a mixture-compressing, spark-ignition internal combustion engine.

To maintain clearance between the fuel injector and the fuel distributor without radial force being exerted, support element 3 must have elasticity and at the same time stability. It includes clamp 8, which rests against a shoulder of the fuel injector and against a shoulder of the fuel distributor. To facilitate installation, clamp 8 has a slit in the area adjacent to an electrical connector of the fuel injector.

Two clips 4 and two brackets 5 are connected to clamp 8 and ensure that the fuel distributor is flexibly braced against the fuel injector. Clips 4 exert a radial clamping force on the fuel distributor and brackets 5 provide elasticity and offset any displacement. In the example shown, clips 4 rest against the fuel distributor, while brackets 5 rest against the fuel injector.

As shown in FIG. 1, support element 3 is designed as a stamped and bent component and, to meet all elasticity and stability requirements, has a very complex shape. It should also be noted that due to the shape of brackets 5 and clips 4 the surfaces which rest against the fuel distributor and the fuel injector are relatively small, and therefore only small areas via which force may be exerted are available. In addition, support element 3 has a cross section which in some areas protrudes beyond the outer contour of the fuel injector, which presents problems in the constricted installation conditions in the cylinder head of the internal combustion engine.

To overcome the described disadvantages, according to the present invention, it is proposed that the shape of support element 3 be designed to allow simplified manufacturing and assembly and a more compact design. Below, an exemplary embodiment of an appropriately shaped support element 3 is described by way of example.

Figure 2:
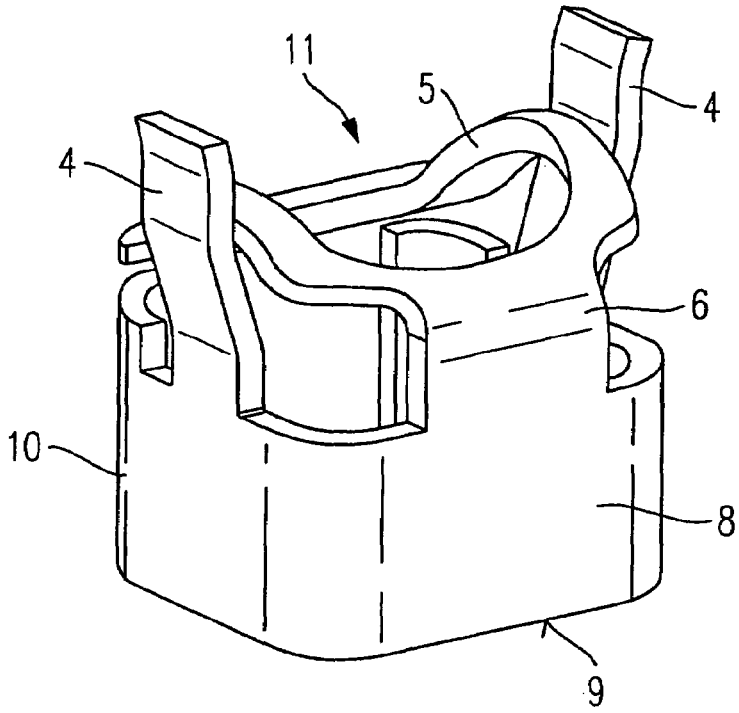
FIG. 2 shows a schematic perspective view of a first exemplary embodiment of a support element according to the present invention.

FIG. 2 shows a schematic perspective view of an exemplary embodiment of a support element 3 according to the present invention.

Support element 3 again includes a clamp 8 which is installed on the fuel injector. Clamp 8 has a slit. Instead of the two brackets 5 shown in FIG. 1, a single bracket 5 is provided, through which fuel injector 1 protrudes, as shown in FIG. 4.

Bracket 5, due to its curved shape and due to projection 6 on clamp 8, is plastically-elastically deformable under axial load, under therefore an axial force may be exerted on fuel injector 1. When the support element is manufactured, first the shape is created by stamping metal, and then it is rolled and bent into shape. Bracket 5 is bent radially inwards so that during installation fuel injector 1 may be pushed through a hole 11 in bracket 5.

Figure 4:
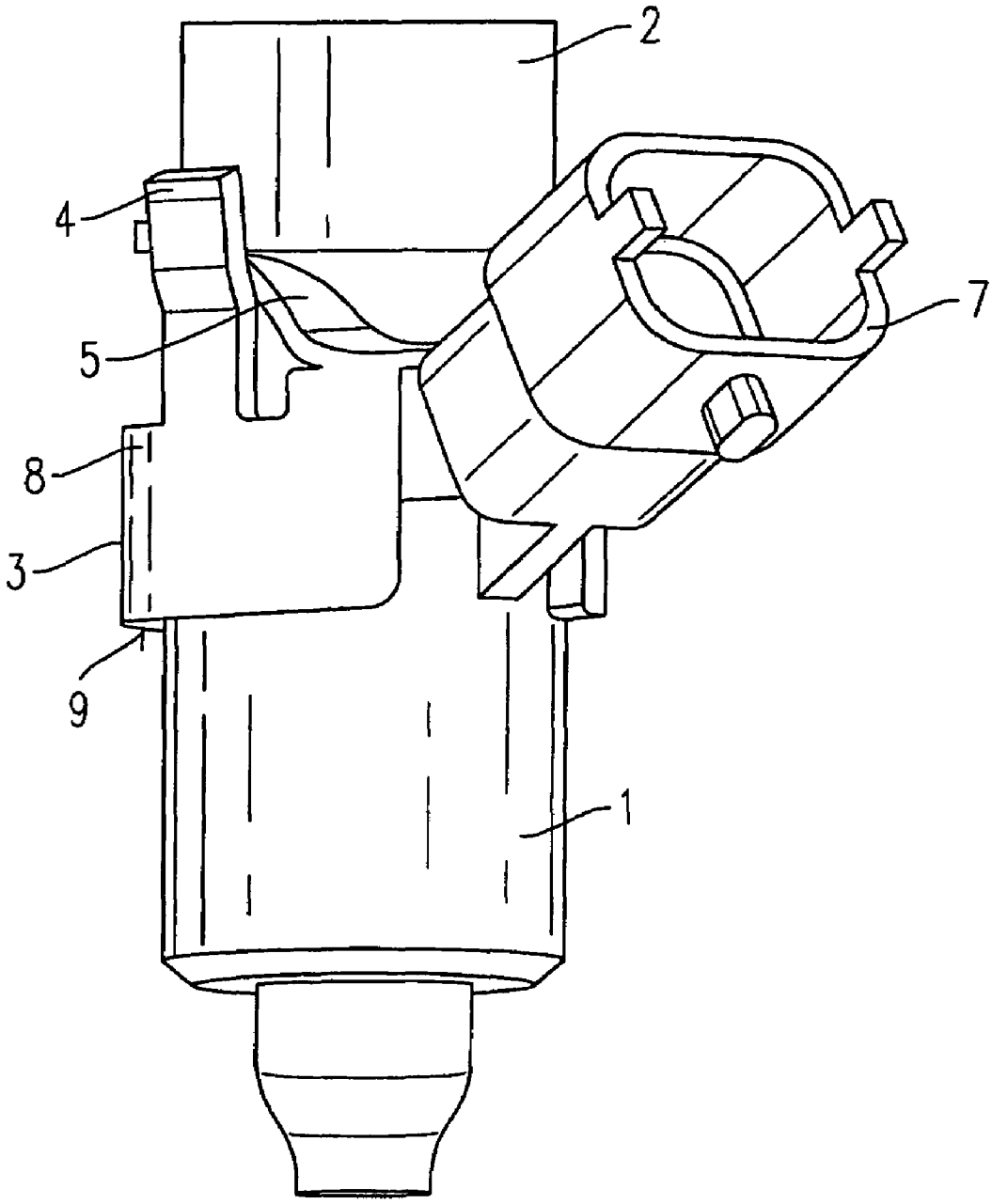
FIG. 4 shows a schematic perspective view of a fuel injector having a support element according to the present invention as shown in FIG. 3, in the installed state.

As shown in FIG. 2 and FIG. 4, the surfaces which rest against fuel distributor 2 and fuel injector 1 are significantly larger than those on support element 3 shown in FIG. 1, as an edge 9 of clamp 8 is available for contact with fuel injector 1 along almost the entire perimeter of fuel injector 1. Bracket 5 also has a larger contact surface which rests against fuel distributor 2, as the contact surface possesses an actual two-dimensional area and is not merely roughly edge-shaped and limited to the thickness of the metal as is the case with the support element shown in FIG. 1.

In conjunction with the curved elastic bracket 5, clips 4, which hold fuel distributor 2, ensure reliable fixing in place and also provide an optimal degree of freedom for offsetting tolerances, changes in length and tilting of fuel injector 1 and fuel distributor 2 relative to one another. This prevents strain and subsequent damage of the various components in an effective manner. In addition, clips 4 ensure that the jet of fuel injector 1 is aligned precisely.

Figure 3:
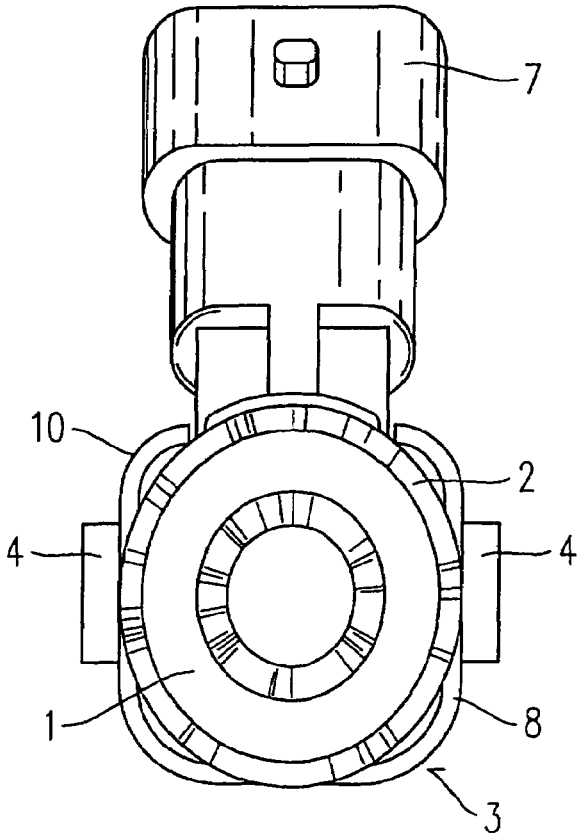
FIG. 3 shows a schematic bottom view of the first exemplary embodiment of a support element according to the present invention shown in FIG. 2, in the installed state.

FIG. 3 shows a bottom view of the exemplary embodiment of support element 3 according to the present invention in the installed state on fuel injector 1.

It is important to note that support element 3 according to the present invention protrudes only slightly beyond the contours of fuel injector 1 and fuel distributor 2 which has been placed on fuel injector 1. Only clips 4 and a small part of corners 10 of clamp 8 are visible. This means there are no additional constraints on conditions during installation of fuel injector 1 in the cylinder head of the internal combustion engine.

Figure 5:
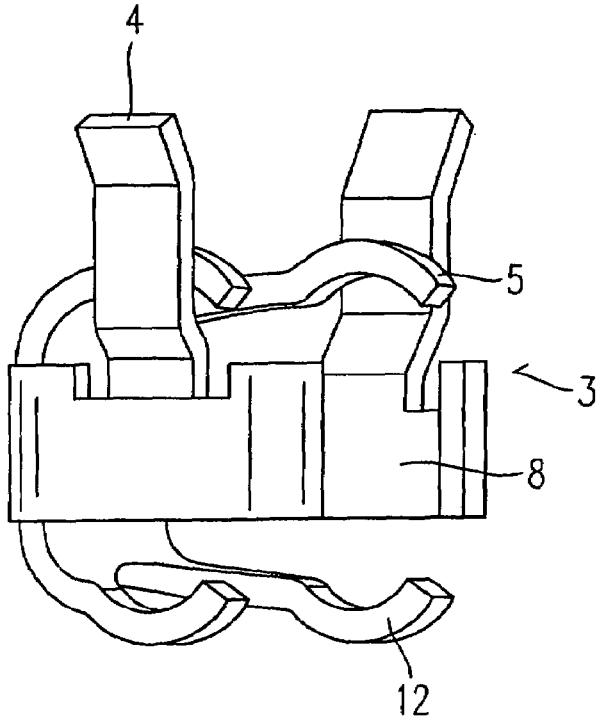
FIG. 5 shows a schematic perspective view of a second exemplary embodiment of a support element according to the present invention.

FIG. 5 shows a perspective view of a second exemplary embodiment of support element 3 according to the present invention.

In addition to open bracket 5, the second exemplary embodiment has a further bracket 12, which is mirror-symmetrical to bracket 5 on support element 3. In the case of the first exemplary embodiment of support element 3 according to the present invention shown in FIGS. 2 through 4, elastic support is only provided for one of the two components, fuel injector 1 or fuel distributor 2, but in the present second exemplary embodiment both components are elastically supported against one another, which ensures further flexibility of support.

Brackets 5 and 12 may both be designed as open as shown in FIG. 5; however, it is also feasible for bracket 5 to be closed as in FIGS. 2 through 4 and for bracket 12 to be open, or vice-versa.

Support element 3 having two brackets 5 and 12 is just as simple and cost-effective to manufacture as support element 3 as shown in FIGS. 2 through 4, because the stamping and bending process steps remain the same.

Figure 6:
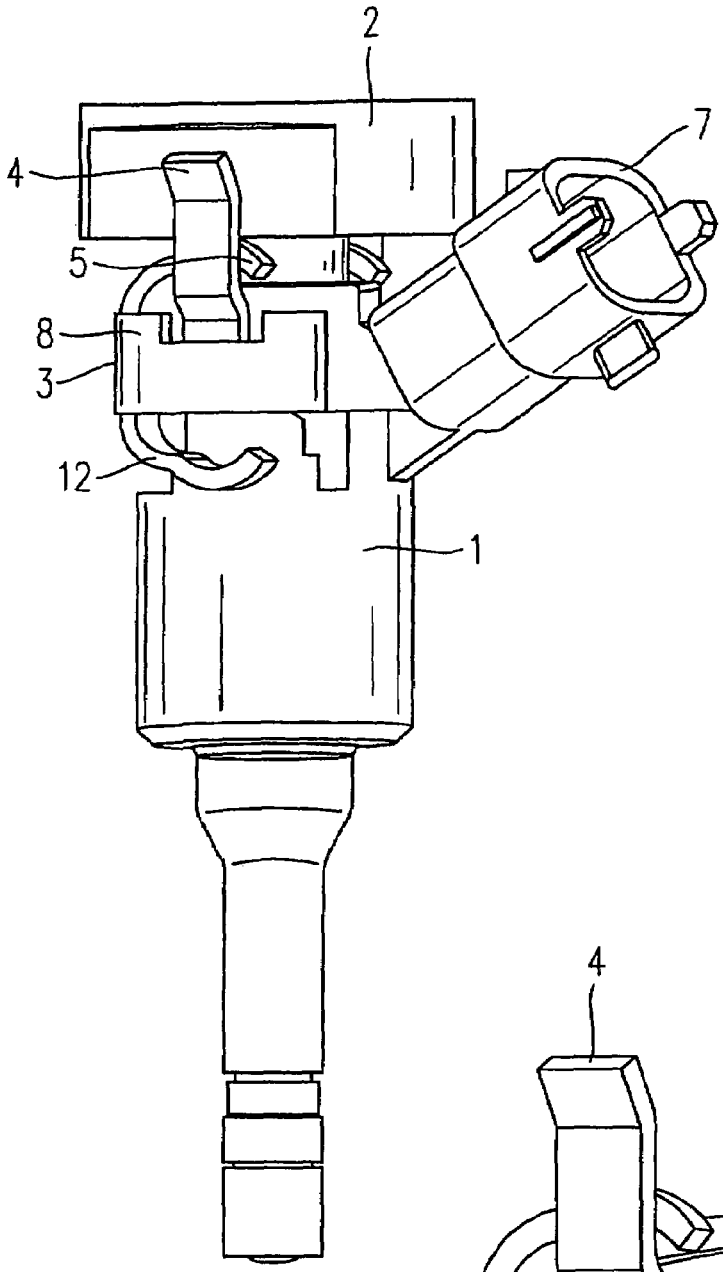
FIG. 6 shows a schematic perspective view of a fuel injector having a support element according to the present invention as shown in FIG. 5, in the installed state.

FIG. 6 shows a schematic perspective view of support element 3 installed between a fuel injector 1 and a fuel distributor, in accordance with the second exemplary embodiment shown in FIG. 5.

Brackets 5 rest against fuel distributor 2 and brackets 12 rest against fuel injector 1. Pressure forces exerted via fuel distributor 2 onto fuel injector 1 may be compensated very effectively using a support element 3 designed in this way.

The present invention is not limited to the exemplary embodiments shown, and for example may also be used for fuel injectors 1 for injecting fuel into the combustion chamber of a self-ignition internal combustion engine. In particular, support element 3 shown in the figures may be installed in reverse position so that bracket 5 rests against fuel injector 1 rather than fuel distributor 2. All features of the present invention may be combined with one another as desired.

What is claimed is:

1. A support element for mutual support of a fuel injector (1) in a valve seat of a cylinder head of an internal combustion engine, and of the fuel injector (1) against a fuel distributor (2), the support element (3) comprising a clamp (8) and clips (4) provided thereon, as well as a bracket (5), wherein the fuel injector (1) protrudes through a hole (11) therein; wherein an edge (9) of the clamp (8) rests circumferentially against one of the fuel injector (1) and the fuel distributor (2).

2. The support element according to claim 1, wherein the bracket (5) rests against the fuel distributor (2) via a planar surface.

3. The support element according to claim 1, wherein the clips (4) rest against the fuel distributor (2).

4. The support element according to claim 1, wherein the bracket (5) rests against the fuel injector (1) via a planar surface.

5. The support element according to claim 4, wherein the clips (4) rest against the fuel injector (1).

6. The support element according to claim 1, wherein the bracket (5) is connected to the clamp (8) via a projection (6).

7. The support element according to claim 6, wherein the bracket (5) on the projection (6) is curved radially inwards.

8. The support element according to claim 1, wherein the bracket (5) is curved.

9. The support element according to claim 1, wherein the number of clips (4) is at least two.

10. The support element according to claim 1, wherein the clamp (8) has a slit in the area of an electrical lead (7) of the fuel injector (1).

11. The support element according to claim 1, wherein the support element (3) has a second bracket (12).

12. The support element according to claim 11, wherein, in relation to the clamp (8), the second bracket (12) is arranged symmetrically thereon.

13. The support element according to claim 11, wherein the second bracket (12) is open.

14. The support element according to claim 11, wherein the bracket (5) has the same shape as the second bracket (12).

15. The support element according to claim 1, wherein the clamp (8) is manufactured by stamping and bending spring steel.

16. The support element according to claim 1, wherein the support element (3) has a rectangular or square cross section.

17. The support element according to claim 1, wherein the fuel injector (1) is flexibly braced against the fuel distributor (2) via the support element (3).

* * * * *